US010842300B2

(12) United States Patent
Reid

(10) Patent No.: US 10,842,300 B2
(45) Date of Patent: Nov. 24, 2020

(54) MOUNTABLE CONTAINER

(71) Applicant: Carl Reid, Charlotte, NC (US)

(72) Inventor: Carl Reid, Charlotte, NC (US)

( * ) Notice: Subject to any disclaimer, the term of this patent is extended or adjusted under 35 U.S.C. 154(b) by 0 days.

(21) Appl. No.: 16/388,633

(22) Filed: Apr. 18, 2019

(65) Prior Publication Data

US 2020/0331654 A1 Oct. 22, 2020

Related U.S. Application Data

(60) Provisional application No. 62/659,809, filed on Apr. 19, 2018.

(51) Int. Cl.

| | |
|---|---|
| ***A47G 7/04*** | (2006.01) |
| *A47F 5/00* | (2006.01) |
| *A47B 57/58* | (2006.01) |
| *A47F 3/14* | (2006.01) |
| *A47F 7/00* | (2006.01) |
| *A47G 7/00* | (2006.01) |

(52) U.S. Cl.

CPC ..... *A47G 7/044* (2013.01); *A47B 57/58* (2013.01); *A47F 3/14* (2013.01); *A47F 5/005* (2013.01); *A47F 7/0078* (2013.01); *A47G 7/00* (2013.01)

(58) Field of Classification Search

CPC ..... B65D 5/4208; B65D 2303/00; F16M 13/022; A47G 7/044; A47G 7/00; B25H 3/02; E04F 11/18; E04F 2011/188; A47F 5/005; A47F 3/14; A47F 7/0078; A47B 57/58

USPC ..... 211/88.03, 85.23; 220/500, 507, 510, 220/529; 206/423

See application file for complete search history.

(56) References Cited

U.S. PATENT DOCUMENTS

| | | | | | |
|---|---|---|---|---|---|
| 1,084,414 | A * | 1/1914 | Eger | A01G 9/02 | 47/68 |
| 1,458,953 | A * | 6/1923 | Robeson | A47B 63/02 | 211/55 |
| 2,422,594 | A * | 6/1947 | Stengren | G11B 33/04 | 312/9.54 |
| 2,459,561 | A * | 1/1949 | Yawman | A47B 88/90 | 220/529 |
| 2,528,819 | A * | 11/1950 | Cohn | B65D 43/20 | 604/403 |
| 2,588,596 | A * | 3/1952 | Weber | A47G 7/044 | 248/311.2 |
| 2,659,917 | A * | 11/1953 | Drum | B44D 3/126 | 15/257.06 |
| 2,702,649 | A * | 2/1955 | Neilson | B25H 3/02 | 220/482 |
| 2,711,436 | A * | 6/1955 | Jones | H05B 6/34 | 373/146 |

(Continued)

*Primary Examiner* — Jonathan Liu
*Assistant Examiner* — Devin K Barnett

(57) ABSTRACT

Provided is a mountable container including a body portion, defined by an exterior wall, at least one partition disposed within a general interior region of the body portion, wherein the at least one partition defines a first interior region and a second interior region, at least one insert disposed within the first interior region, the insert having a ramped surface with respect to a flat bottom surface of the first interior region, wherein, when the body portion is mounted to a sloped structure at a slope corresponding to a slope of the sloped structure, the ramped surface of the insert is flat with respect to a ground surface. An associated method is also provided.

7 Claims, 9 Drawing Sheets

(56) References Cited

U.S. PATENT DOCUMENTS 2,734,350 A * 2/1956 Budd ..... F25C 1/246 249/72
2,770,513 A * 11/1956 Brown ..... A47C 7/62 220/482
2,982,423 A * 5/1961 Handler ..... A47F 5/0025 211/126.1
3,097,746 A * 7/1963 Handler ..... A47F 5/0025 211/133.3
3,429,427 A * 2/1969 Tobin ..... A47F 3/145 206/214
3,550,319 A * 12/1970 Gaines, Jr. ..... A01G 31/02 47/79
3,622,032 A * 11/1971 Tilche ..... A24F 19/08 220/502
3,661,271 A * 5/1972 Fisher ..... A47F 5/0025 211/88.01
3,703,326 A * 11/1972 Riviers ..... A47B 88/90 312/348.3
3,710,900 A * 1/1973 Fink ..... A45C 13/02 206/387.15
3,751,172 A * 8/1973 Seitz ..... B01L 9/06 356/244
3,752,494 A * 8/1973 Dunn ..... B44D 3/126 280/47.26
3,802,844 A * 4/1974 Sendra ..... B01L 9/06 422/562
4,109,797 A * 8/1978 Brunette ..... A47F 5/12 108/108
4,131,203 A * 12/1978 Bridges ..... A47F 5/0025 108/32
4,412,618 A * 11/1983 La Conte ..... B25H 3/06 132/286
D281,658 S * 12/1985 Kikutani ..... D6/407
4,593,816 A * 6/1986 Langenbeck ..... B65D 25/06 206/425
4,765,492 A * 8/1988 Howard ..... A47B 96/06 108/61
4,826,013 A * 5/1989 Heikkinen ..... B65F 1/0046 206/518
4,828,121 A * 5/1989 Willcocks, Jr. ..... A47F 5/0068 211/126.1
4,993,583 A * 2/1991 Chasen ..... A47F 1/04 206/362
D317,220 S * 5/1991 Diamond ..... D3/305
D322,697 S * 12/1991 Nguyen ..... D32/56
5,090,587 A * 2/1992 Brown ..... A47F 5/0018 211/81
5,095,653 A * 3/1992 Guldberg ..... A01G 9/023 47/83
5,163,549 A * 11/1992 Hayduchok ..... A45C 11/34 206/214
5,441,707 A * 8/1995 Lewis ..... A61L 2/06 422/300
D392,804 S * 3/1998 Wilkening ..... D3/307
5,743,416 A * 4/1998 Yemini ..... B25H 3/04 211/70.6
5,810,182 A * 9/1998 Levin ..... A47F 5/112 211/195
5,884,889 A * 3/1999 Crosby ..... A47B 23/04 248/444
5,961,927 A * 10/1999 Isaacs ..... B01L 9/54 211/60.1
5,975,318 A * 11/1999 Jay ..... A47F 5/101 211/150
6,082,553 A * 7/2000 Stravitz ..... A47B 63/00 206/308.1
6,116,434 A * 9/2000 Park ..... A47B 81/00 211/71.01
6,129,219 A * 10/2000 Peickert ..... A47B 45/00 211/74
6,499,249 B1 * 12/2002 Luijkx ..... A47F 7/0078 206/423
6,615,542 B2 * 9/2003 Ware ..... A01G 31/02 47/83
D487,193 S * 3/2004 Liu ..... D3/313
6,883,671 B2 * 4/2005 Rushing ..... A47F 5/0018 206/736
6,957,739 B1 * 10/2005 Stephenson ..... A47F 3/14 206/443
D516,914 S * 3/2006 Ducharme ..... D9/456
7,121,104 B2 * 10/2006 Howington ..... A47B 57/045 62/256
D558,584 S * 1/2008 Blank ..... D9/560
D595,466 S * 6/2009 Sofy ..... D32/56
8,250,804 B2 * 8/2012 Chang ..... A01G 9/025 47/39
8,893,886 B2 * 11/2014 Tsukaguchi ..... B25B 15/008 206/377
8,925,744 B1 * 1/2015 Jang ..... A47F 1/12 211/126.12
8,955,696 B2 * 2/2015 Wang ..... A47F 7/0071 206/499
8,967,379 B2 * 3/2015 Kinskey ..... B25H 3/023 150/113
9,357,715 B2 * 6/2016 Cottrell ..... A01G 22/00
9,386,865 B2 * 7/2016 Bally ..... A47F 3/14
9,468,313 B2 * 10/2016 Kniffen ..... A47F 5/005
9,545,151 B2 * 1/2017 Kaelin ..... B08B 9/42
9,622,941 B2 * 4/2017 Sharpe ..... B01L 9/06
9,907,727 B2 * 3/2018 Sharpe ..... A61J 1/16
D846,281 S * 4/2019 Greenwood ..... D3/313
D848,151 S * 5/2019 Greenwood ..... D3/313
10,470,593 B2 * 11/2019 Kalm ..... A47F 7/0021
2002/0024273 A1 * 2/2002 Osawa ..... A47F 5/16 312/128
2003/0010743 A1 * 1/2003 Boukobza ..... B65D 1/0223 215/382
2004/0108433 A1 * 6/2004 Gunsch ..... A47B 23/002 248/346.01
2004/0211736 A1 * 10/2004 Mason ..... A47F 1/12 211/59.2
2004/0244129 A1 * 12/2004 Emerson, Jr. ..... B65G 69/30 14/69.5
2006/0011686 A1 * 1/2006 Latham ..... B60R 7/04 224/579
2006/0043038 A1 * 3/2006 Wetzel ..... A47G 7/044 211/88.03
2006/0060547 A1 * 3/2006 Chang ..... A47F 1/12 211/73
2007/0062839 A1 * 3/2007 Patterson ..... B65D 25/06 206/523
2007/0295681 A1 * 12/2007 Colin ..... A47F 5/13 211/90.03
2008/0120902 A1 * 5/2008 Laycock ..... A01G 9/028 47/39
2008/0185387 A1 * 8/2008 Wu ..... A47B 88/988 220/510
2008/0230666 A1 * 9/2008 Quinones Farfan ..... A47F 1/12 248/235
2008/0302744 A1 * 12/2008 Rosenberg ..... A47F 5/0846 211/94.01
2009/0084786 A1 * 4/2009 Claypool ..... A47J 47/04 220/254.9
2009/0145869 A1 * 6/2009 Battaglia ..... A47F 5/0056 211/153
2009/0293350 A1 * 12/2009 Kania ..... A01G 9/023 47/29.1
2010/0037517 A1 * 2/2010 Copping ..... A01G 27/005 47/79
2010/0127002 A1 * 5/2010 Bel ..... E04D 15/00 220/629
2010/0270193 A1 * 10/2010 Eaton ..... A45C 13/00 206/372
2011/0017685 A1 * 1/2011 Brown ..... A47F 7/0028 211/60.1
2011/0036008 A1 * 2/2011 Hashimoto ..... A01G 9/025 47/82

(56) References Cited

U.S. PATENT DOCUMENTS

2011/0258925 A1* 10/2011 Baker ..... A01G 9/023 47/65.8
2012/0066972 A1* 3/2012 Lin ..... A01G 9/024 47/82
2012/0227320 A1* 9/2012 Dos Santos ..... A01G 9/025 47/79
2012/0228304 A1* 9/2012 Rueckheim ..... A47L 13/58 220/500
2012/0298599 A1* 11/2012 Sichello ..... A01G 9/025 211/49.1
2013/0008818 A1* 1/2013 Ahag ..... A61J 7/0481 206/438
2013/0152467 A1* 6/2013 Chang ..... A01G 9/025 47/82
2013/0213911 A1* 8/2013 Theisen ..... A47F 5/0062 211/59.4
2013/0227884 A1* 9/2013 Park ..... B01D 53/84 47/66.6
2013/0264351 A1* 10/2013 Bogdziewicz, III ..... A47F 1/08 221/1
2013/0277322 A1* 10/2013 Tiberio ..... A61B 50/24 211/74
2014/0048435 A1* 2/2014 Ullrich ..... B65D 85/52 206/423
2014/0291184 A1* 10/2014 Mannoni ..... A01G 9/026 206/423
2015/0014492 A1* 1/2015 Sharpe ..... F16M 13/02 248/121
2015/0096229 A1* 4/2015 Chang ..... A01G 27/005 47/82
2015/0150198 A1* 6/2015 Sinha ..... A01G 27/00 47/82
2015/0230412 A1* 8/2015 Ito ..... A01G 9/025 47/66.7
2015/0230630 A1* 8/2015 Taylor ..... A47F 5/16 29/426.2
2018/0178336 A1* 6/2018 Gussmann ..... B25H 3/003
2018/0295800 A1* 10/2018 Kiernan ..... A01G 31/06
2019/0159609 A1* 5/2019 Kalm ..... A47F 5/0062

* cited by examiner

MOUNTABLE CONTAINER

CROSS-REFERENCE TO RELATED APPLICATIONS

This application claims priority to U.S. Provisional Application No. 62/659,809, filed Apr. 18, 2019, and entitled "Mountable Container."

FIELD OF TECHNOLOGY

The following relates to a mountable container, and more specifically to embodiments of a container that can be mounted to a sloped structure while maintaining contents within the container relatively level.

BACKGROUND

Attaching level objects to sloped structures can interfere with the levelness of contents places within the object. For example, if an object is mounted to a sloped object, such as stairs, contents within the object may be urged to one side or the other, depending on the incline. When the contents are displayed in the object attached to the sloped structure, the appearance may be aesthetically unpleasant.

Thus, a need exists for a container that can be mounted to a sloped structure while maintaining contents within the container relatively level.

SUMMARY

A first aspect relates to a mountable container including a body portion, defined by an exterior wall, at least one partition disposed within a general interior region of the body portion, wherein the at least one partition defines a first interior region and a second interior region, at least one insert disposed within the first interior region, the insert having a ramped surface with respect to a flat bottom surface of the first interior region, wherein, when the body portion is mounted to a sloped structure at a slope corresponding to a slope of the sloped structure, the ramped surface of the insert is flat with respect to a ground surface A second aspect relates to mountable container that can be mounted to a sloped structure while maintaining contents within the container relatively level.

A third aspect relates to a method for maintaining a flat display surface within a sloped container, the method comprising: disposing a ramped insert into an interior region of the sloped container.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus, method, and system are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
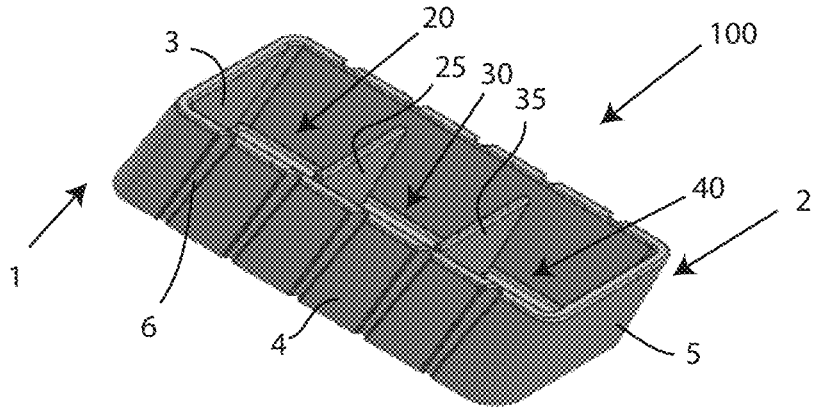
FIG. 1 depicts a perspective, top view of a container, in accordance with embodiments of the present invention.
Figure 2:
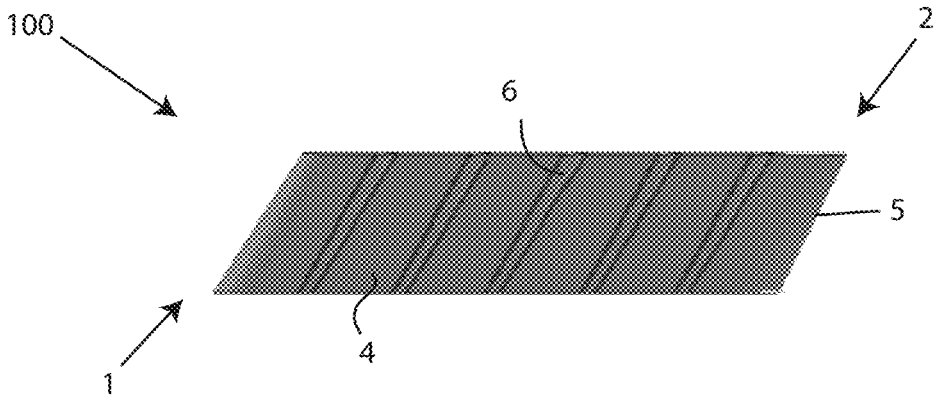
FIG. 2 depicts a side view of the container in a level orientation, in accordance with embodiments of the present invention.
Figure 3:
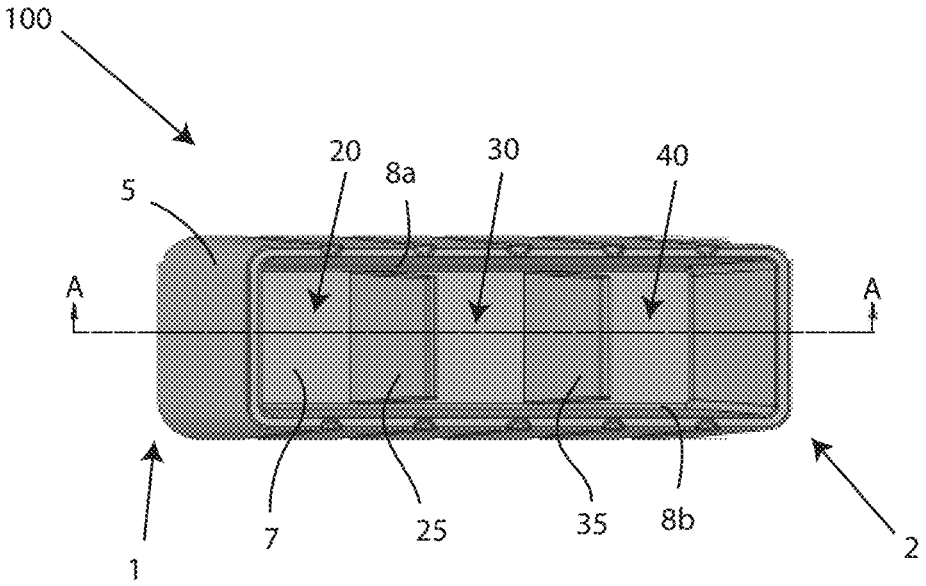
FIG. 3 depicts top view of the container, in accordance with embodiments of the present invention.

Referring now to the drawings, FIGS. 1-3 depict a container 100, in accordance with embodiments of the present invention. Embodiments of the container 100 may be a container, a storage container, a storage box, a display case, a display box, a contents holder, a basket, a receptacle, and the like. Embodiments of the container 100 may be configured to mount, attach, secure, or otherwise couple to a structure, such as a sloped structure. In an exemplary embodiment, the container 100 may be a planter, a flower box, a plant holder, and the like. For instance, embodiments of the container 100 may store, hold, receive, display, accept, etc. plant contents therein. Plant contents contained within the container 100 may be plants, flowers, soil, seeds, vegetables, herbs, and the like. In other embodiments, the container 100 may store, hold, receive, display, accept, etc. various types of contents, such as tools, materials, books, beverages, kick-knacks, or any tangible items that can fit within the container 100. Further, embodiments of the container 100 may be mounted to a sloped structure in a sloped orientation, while maintaining contents within the container relatively level or parallel with a ground surface.

Embodiments of the container 100 may include a first end 1, a second end 2, and an inner surface 4. A shape or general body structure of the container 100 may be defined by an exterior wall 5. The exterior wall 5 may form a generally rectangular shaped container 100, having rounded or squared edges. A plurality of grooves 6 may be disposed on the exterior wall 5 at various locations along the exterior wall 5. Embodiments of the grooves 6 may be grooves, channels, voids, openings, slots, etc., which can be spaced a distance apart from each other. For instance, embodiments of the grooves 6 may be spaces apart from each other a distance that corresponds to a standard distance between spindles of a stair case. In one embodiment, the grooves 6 may be sized and dimensioned to snugly accept a spindle of a stair case for added stability when mounted to a sloped structure, such as a stair case. For example, a spindle or other vertical structural element of a sloped structure may be received within the grooves 6 such via an interference fit to enhance a connection between the container 100 and the sloped structure. In other embodiments, the grooves 6 may not be used to enhance the connection between the container 100 and the sloped structure, relying solely on a mounting element as described infra.

Moreover, embodiments of the container 100 may have a general interior region for receiving contents, such as soil, seeds, plants, etc. The general interior region may be a region, area, space, void, etc. between a bottom surface of the container 100 and the exterior wall 5. The interior region may be partitioned into multiple interior regions with one or more partitions. For instance, embodiments of the container 100 may include a first partition 25 and a second partition 35, which may partition or otherwise divide the general interior region of the container 100 into a first interior region 20, a second interior region 30, and a third interior region 40. Embodiments of the container 100 may include more than two or less than two partitions to form more than three or less than three separate interior regions. Additionally, the partitions 25, 35 may be spaced apart from each other to create equal or non-equal sized interior regions 20, 30, 40. Embodiments of the partitions 25, 35 may be a partition, a divider, a wall, and the like. Embodiments of the interior regions 20, 30, 40 may be an interior region, a cavity, space, a receiving area, a receptacle, a storage area, and the like.

Figure 4:
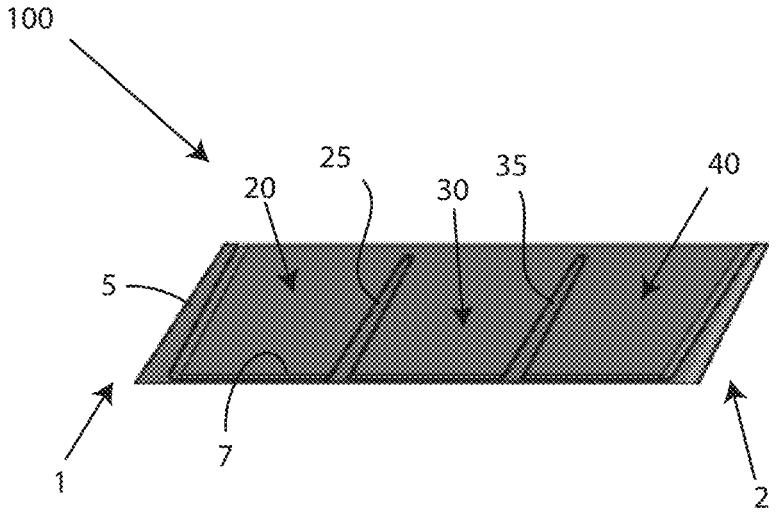
FIG. 4 depicts a cross-sectional view along line A-A of FIG. 3, in accordance with embodiments of the present invention.

FIG. 2 depicts aside view of the container 100 in a level orientation, in accordance with embodiments of the present invention. In a level orientation, the partitions 25, 35 may be oblique or non-parallel to a ground surface. Similarly, the grooves 6 may be oblique or non-parallel to the ground surface in the level orientation depicted in FIG. 2. FIG. 4 shows the partitions 25, 35 may be non-parallel to a ground surface in a level orientation. For operable mounting to a sloped structure, the container 100 may be rotated such that the partitions 25, 35 become perpendicular or substantially perpendicular to the ground surface as described in greater detail infra.

Figure 5:
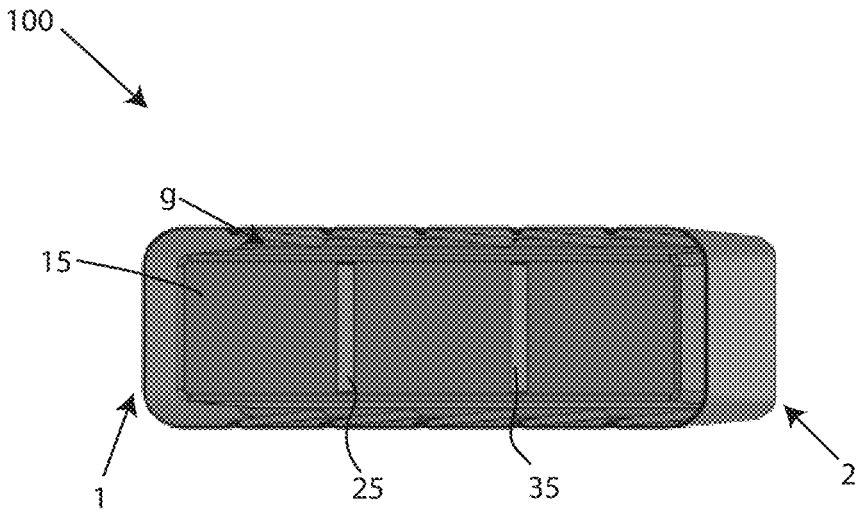
FIG. 5 is a perspective, bottom view of the container, in accordance with embodiments of the present invention.

Referring back to FIG. 3, which depicts top view of the container 100 in accordance with embodiments of the present invention. Embodiments of the container 100 may have a bottom surface 7. The bottom surface 7 of the container 100 may be level or parallel with a flat, ground surface, in a level orientation, as shown in FIG. 4. Each interior region 20, 30, 40 may have a bottom surface 7 for supporting contents placed within the container 100. Furthermore, embodiments of the container 100 may include flow channels 8*a*, 8*b* extending lengthwise from the first end 1 towards the second end 2 of the container 100. Embodiments of the flow channels 8*a*, 8*b* may be a flow path, a channel, a groove, a slot, a drain, an irrigation channel, or other fluidic pathway. The flow channels 8*a*, 8*b* may allow water or other flowable materials to flow therethrough to fluidically connect the interior regions 20, 30, 40. For example, water entering or accumulating within the container 100 may flow across the bottom surface 7 of the container 100 and into the flow channels 8*a*, 8*b* for displacement to another section of the container 100. The flow channels 8*a*, 8*b* may be disposed along or otherwise proximate an edge formed between the bottom surface 7 and the inner surface 3 of the exterior wall 5. As shown in FIGS. 3 and 5, the flow channels 8*a*, 8*b* may pass between a space, gap, etc. between the partitions 25, 35 and the exterior wall 5 to connect the interior regions 20, 30, 40 of the container 100.

Furthermore, as shown in FIG. 5, a gap g may exist between the general receiving structure of the container 100 and the exterior wall 5. The gap g may permit the constructions of the grooves 6 along the exterior wall 5, wherein portions of the exterior wall 5 protrude inwardly towards the general interior of the container 100. FIG. 5 also shows one method for manufacturing the partitions 25, 35, in which the partitions 25, 35 are extruded to form a wall within the general interior of the container 100, such that the entire container 100 may be produced as a single component. In other words, the container 100 may be entirely structurally integral. In an exemplary embodiment, the container 100 may be comprised of one or more plastics. Other manufacturing methods and materials may be used to manufacture the container 100.

Figure 6:
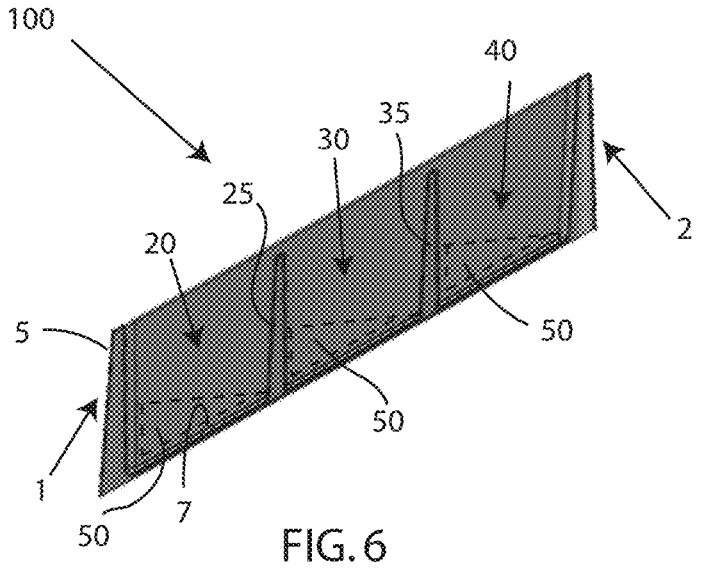
FIG. 6 depicts a cross-sectional view along line A-A of FIG. 3 in an operable configuration, in accordance with embodiments of the present invention.
Figure 7:
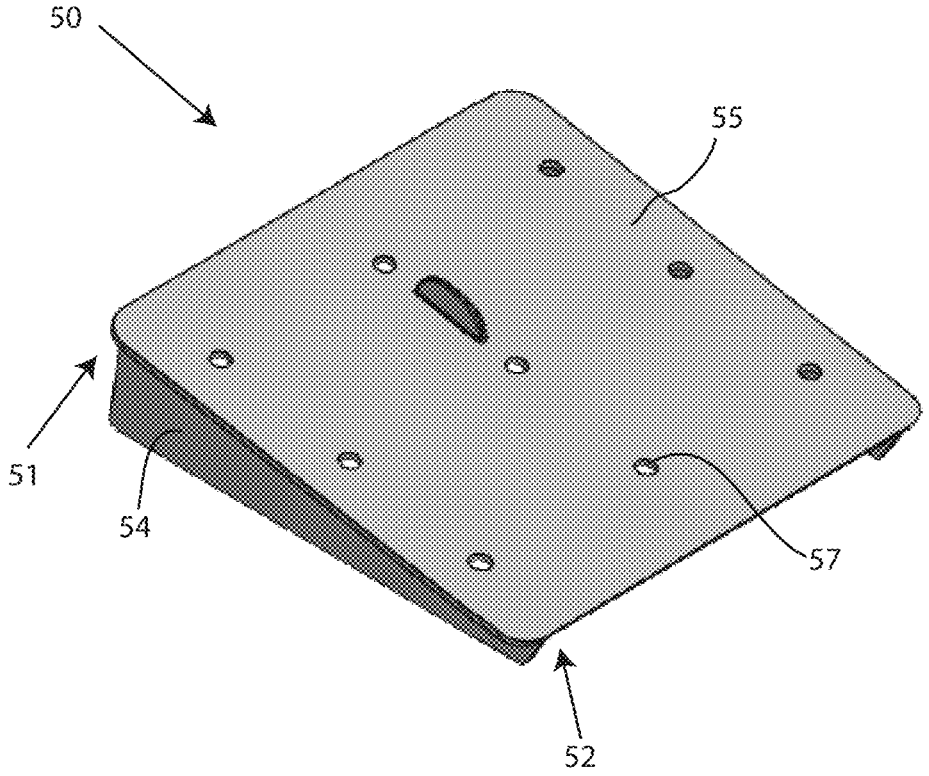
FIG. 7 depicts a perspective view of an insert insertable into the container, in accordance with embodiments of the present invention.
Figure 8:
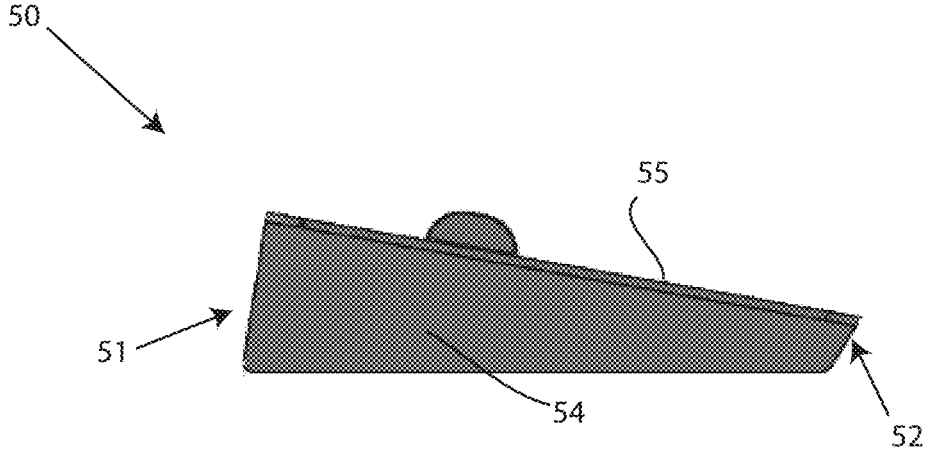
FIG. 8 depicts a side view of the insert, in accordance with embodiments of the present invention.

Referring now to FIG. 6, which depicts a cross-sectional view along line A-A of FIG. 3 in an operable configuration, in accordance with embodiments of the present invention. The operable configuration of the container may be a sloped, inclined, declined, or ramped orientation. The sloped operable configuration may correspond to a slope of a sloped structure to which the container 100 is to be mounted. In the operable configuration, embodiments of the partitions 25, 35 may be perpendicular or substantially perpendicular to a ground surface, while the general body of the container 100 is sloped, inclined, declined, or ramped. If contents were to be placed within the container 100 in this configuration, the contents would not likely be level, and likely be urged towards the first end 1 due to gravity. This may result in an aesthetically displeasing display of contents placed therein, or generally disorganization of objects placed therein. However, embodiments of the container 100 may include inserts 50 that can be inserted into the interior regions 20, 30, 40 to effectuate a level or flat surface, within a generally sloped container 100.

FIGS. 7-11 depict embodiments of insert 50, in accordance with embodiments of the present invention. Embodiments of insert 50 may be an insert, a wedge element, a leveling element, and the like. Embodiments of the insert 50 may include a ramped surface 55. The ramped surface 55 may be ramped and supported by two feet 54 extending from a first end 51 of the insert 50 to a second opposing end 52 of the insert 50. The feet 54 may be a tapered wall structure, having a height greater proximate the first end 51 than a height proximate the second end 52. In an operable configuration, inserts 50 may be inserted or otherwise received within the interior regions 20, 30, 40, such that the first end 51 of the insert 50 is placed closer to the first end 1 of the container 100, when the first end 1 of the container 1 is lower elevationally than the second end 2. Due to the tapered structure of the feet 54 of the insert 50, the ramped surface 55 may actually be flat or level with respect to a ground surface when the container 100 is mounted to the sloped structure 100 in a correspondingly sloped orientation. Moreover, contents may be placed directly onto the ramped surface 55 (which is level in the operable configuration). The surface 55 may include a projection, tab, or void to facilitate lifting the insert 50 out of the container 100. Such projection or tab may be a hook, ring, circle, semicircle, rod, depression, hole, cylinder, screw, string, chain, or disc. The surface 55 may include one or more openings 57 for draining water or other flowable materials. For instance, if the container 100 is mounted outdoors and collects rain water, or mounted indoors or outdoors and a user waters the contents placed on the surface 55, water may pass through the openings 55 and flow to the bottom surface 7 of the container 100. The water may then flow to the flow channels 8*a*, 8*b* to flow from one interior region to the next, depending on the gravitational force acting upon the container 100. The bottom surface 7 may also have drain holes to allow water to flow out of the container 100 into the external environment. Such an arrangement may be beneficial when container is placed in an area which experiences excessive water entering container 100.

Figure 9:
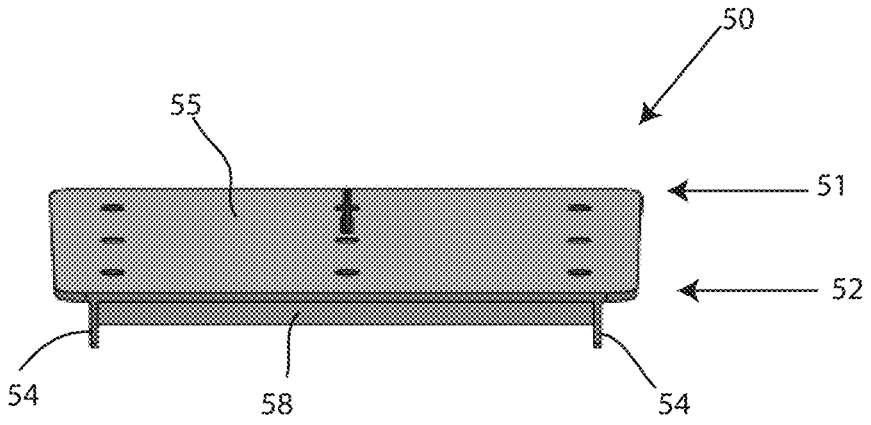
FIG. 9 depicts a front view of the insert, in accordance with embodiments of the present invention.
Figure 10:
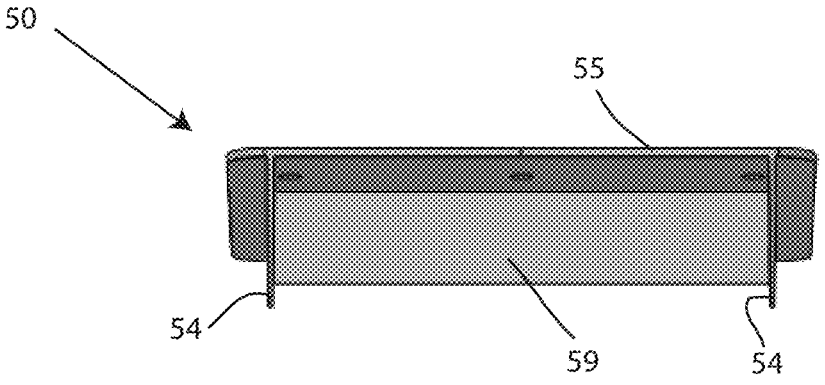
FIG. 10 depicts a rear view of the insert, in accordance with embodiments of the present invention.
Figure 11:
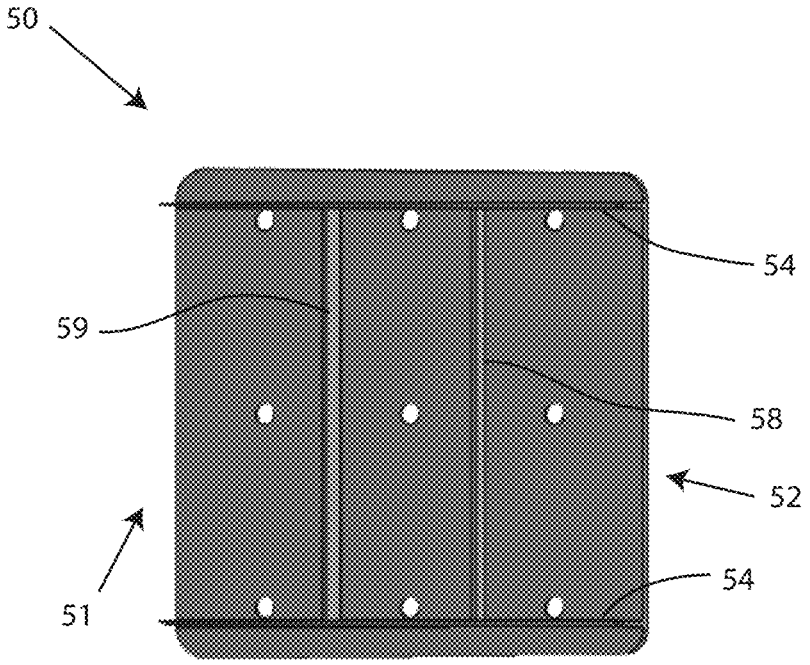
FIG. 11 depicts a bottom view of the insert, in accordance with embodiments of the present invention.

FIGS. 9-11 depict supporting structure 58, 59 which may interconnect the two feet 54 of the insert 50. The first supporting structure 58 may have a smaller height than a height of a second supporting structure 59. The supporting structure 58, 59 may provide additional structural integrity to the insert 50, which may experience loads from contents placed onto the ramped surface 55.

In alternative embodiments, the inserts 50 may be permanently disposed within the container 100 using one or more fasteners, adhesive, etc. In addition, the insert 50 may alternatively not be configured to be removed or inserted, but rather may be formed structurally integral with the general body structure of the container 100 during a manufacturing process.

Figure 12:
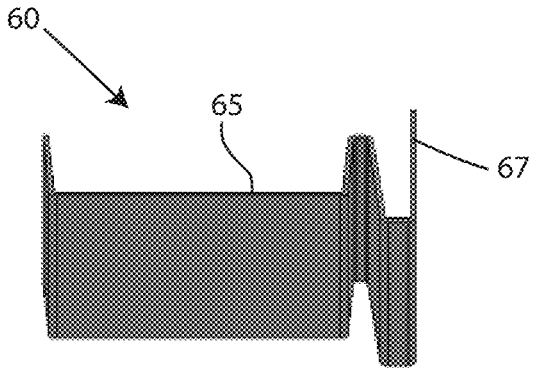
FIG. 12 depicts a bottom, perspective view of a mounting element for the container, in accordance with embodiments of the present invention.
Figure 13:
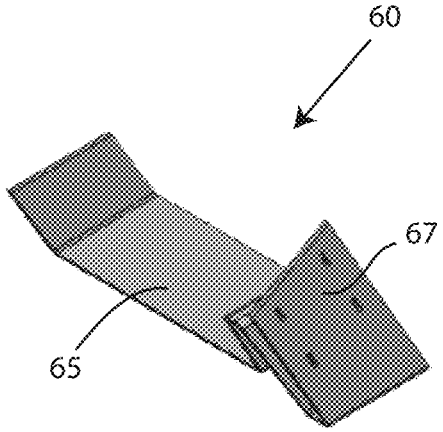
FIG. 13 depicts a top, perspective view of the mounting element, in accordance with embodiments of the present invention.
Figure 14:
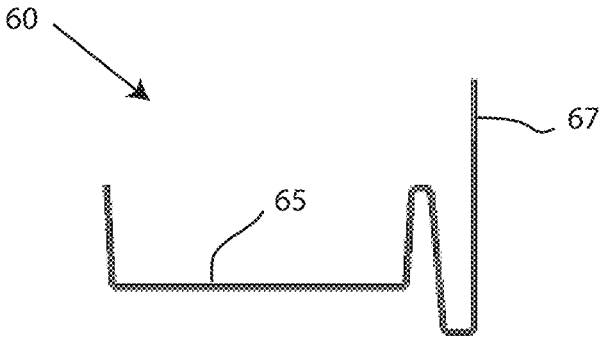
FIG. 14 depicts a side view of the mounting element, in accordance with embodiments of the present invention.

Referring now to FIGS. 12-14, embodiments of the container 100 may be connected to a sloped structure using one or more mounting elements 60. Embodiments of the mounting element 60 may be a mount, a bracket, an attachment mechanism, and the like, configured to removable secure, attach, or otherwise affix the container 100 to a sloped structure. Embodiments of the mounting element 60 may have a support surface 65 and a securing portion 67. The support surface 65 may be a flat surface that accommodates, receives, supports, engages, etc. with an exterior bottom surface 15 of the container 100 (shown in FIG. 5). Embodiments of the securing portion 67 may engage with a surface or section of the sloped surface for fastening the mounting element 60 to the sloped structure, which as a result supports and connects the container 100 to the sloped structure.

Figure 15:
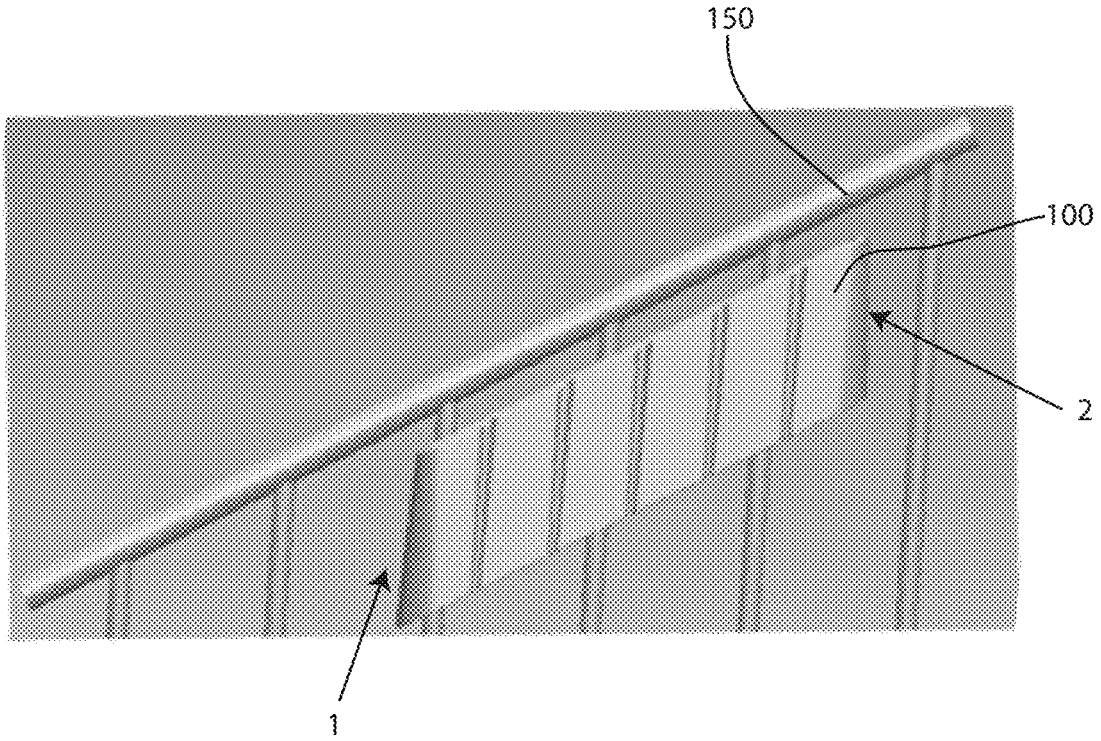
FIG. 15 depicts a view of the container mounted to a sloped structure, in accordance with embodiments of the present invention.
Figure 16A:
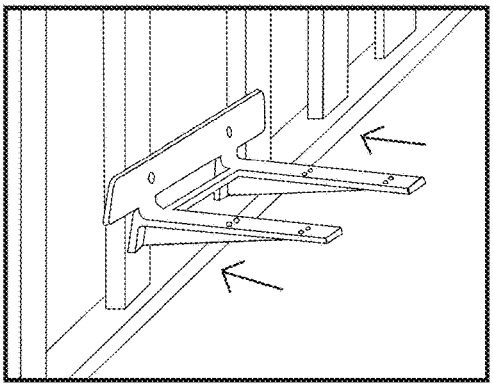
FIG. 16*a* depicts a first installation step, in accordance with embodiments of the present invention.
Figure 16D:
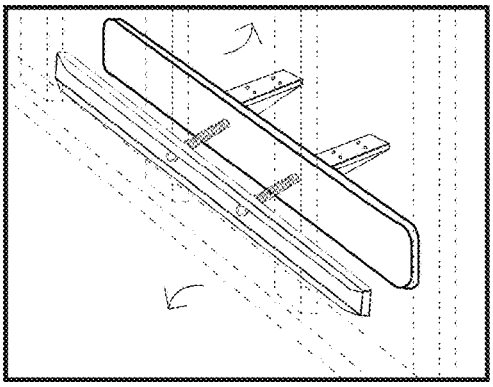
FIG. 16*d* depicts a fourth installation step, in accordance with embodiments of the present invention.
Figure 16B:
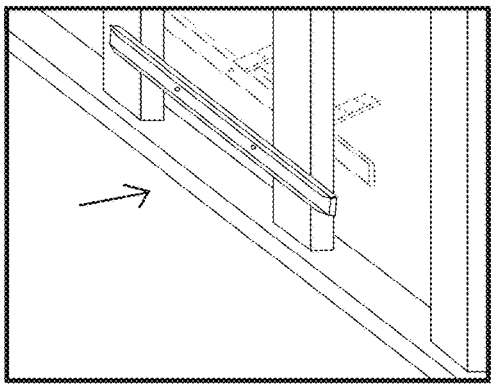
FIG. 16*b* depicts a second installation step, in accordance with embodiments of the present invention.
Figure 16E:
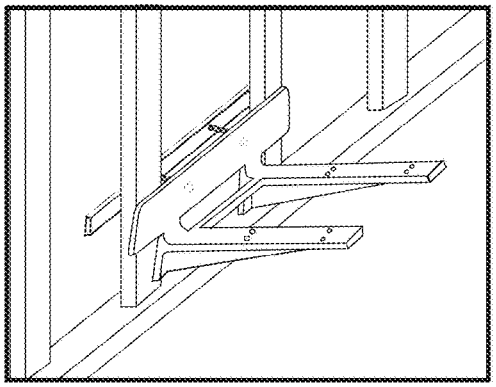
FIG. 16*e* depicts a fifth installation step, in accordance with embodiments of the present invention.
Figure 16C:
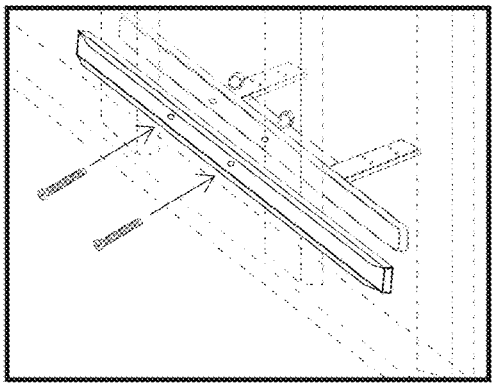
FIG. 16*c* depicts a third installation step, in accordance with embodiments of the present invention.
Figure 16F:
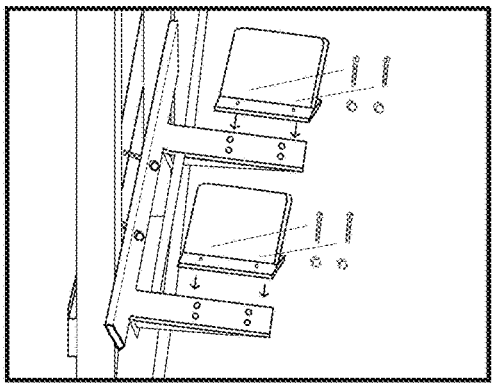
FIG. 16*f* depicts a sixth installation step, in accordance with embodiments of the present invention.
Figure 16G:
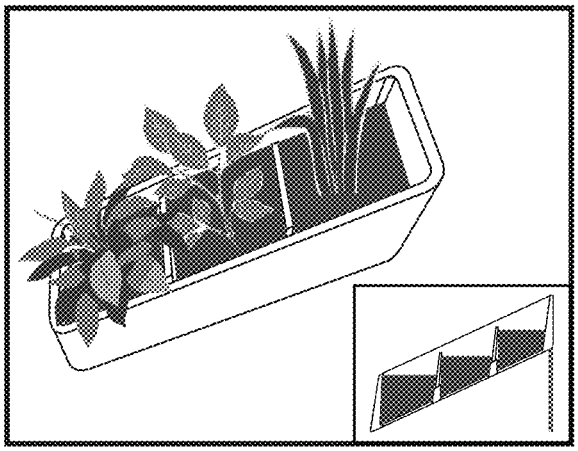
FIG. 16*g* depicts a seventh installation step, in accordance with embodiments of the present invention.
Figure 16H:
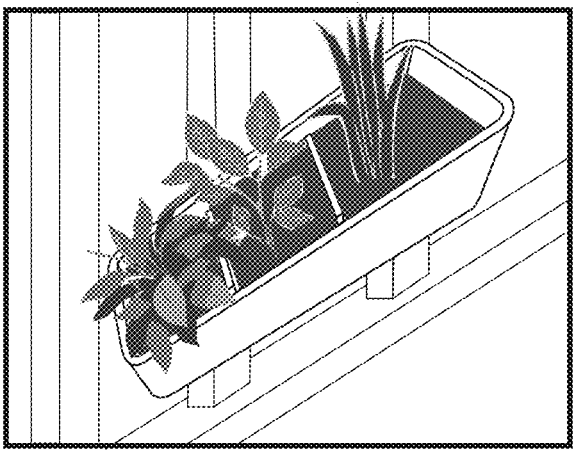
FIG. 16*h* depicts an eighth installation step, in accordance with embodiments of the present invention.
Figure 16I:
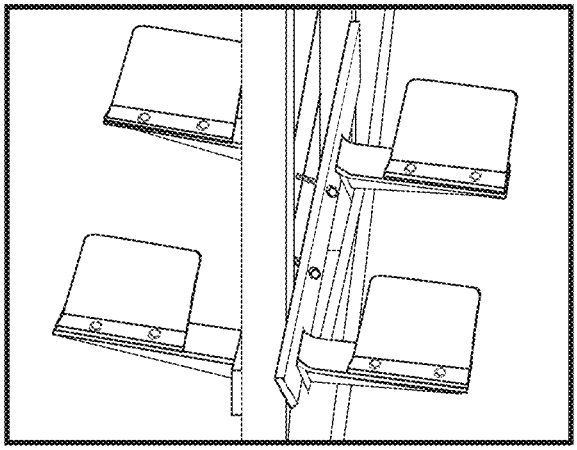
FIG. 16*i* depicts a ninth installation step, in accordance with embodiments of the present invention.

FIG. 15 depicts a view of the container 100 mounted to a sloped structure 150, in accordance with embodiments of the present invention. While mounted to the sloped structure 150, such as a stair handrail, the container 100 may be ramped, such that the first end 1 of the container 1 is at a lower elevation than the second end 2. However, because of the ramped inserts 50, a flat surface for placing contents within the container 100 may be level or flat with respect to a ground surface.

FIGS. 16*a*-16*i* depict another manner in which the container 100 can be mounted to a sloped structure, such as stairs, railings, balcony, etc, or any structure having railings or spindles. In a first installation step, arms are placed on the side of the stairs that the user desires to have the container 100 mounted. The single flat base of the arms is pressed against the railings of the stairs. In a second installation step, a stabilizer bar is placed on the opposite side of the railing with the flat side of the stabilizer bar pressed against or at least facing the railing. In a third installation step, fasteners, such as screws, are placed through the stabilizer bar and into the arms. Couplers (e.g. nuts) are then tightened enough to prevent the unit from sliding down the railing. In a fourth installation steps, the arms and/or stabilizer bar are adjusted to match the incline of the handrail or footrail of the railing, and the unit is slide to desired height. In a fifth installation step, the fasteners and couplers are tightened until there is no movement of the unit. In a sixth installation step, one or more hands are placed on the arms, making sure that the hands are pointed toward upstairs. Insert fasteners and couplers as shown, and tighten. In a seventh installation step, soil and/or desired flowers/plants are optionally placed in each pod of the container 100. In an eighth installation step, the container 100 is placed on the assembled unit (i.e. comprising the hands, stabilizer bar, and the arms. In an optional ninth installation step, two arms may be used (e.g. one on each side of the railing) to effect a double-sided installation on a single railing.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

The invention claimed is:

1. A mountable container comprising:

a body portion, defined by an exterior walls surrounding a flat bottom surface, wherein at least two corresponding exterior walls from said exterior walls are sloped with respect to the flat bottom surface;

at least one partition disposed within an interior of the body portion and being sloped with respect to the flat bottom surface, wherein the at least one partition is substantially parallel to the at least two corresponding exterior walls, wherein the at least one partition divides the interior into a first interior region and a second interior region;

at least one insert disposed within the first interior region, the at least one insert having a ramped surface with respect to the flat bottom surface of the body portion within the first interior region;

wherein, when the body portion is mounted to a sloped structure at a slope corresponding to a slope of the sloped structure, the ramped surface of the at least one insert is flat with respect to a ground surface.

2. The mountable container of claim 1, further comprising an additional insert inserted into the second interior region.

3. The mountable container of claim 1, wherein the ramped surface of the at least one insert includes a plurality of openings.

4. The mountable container of claim 1, further comprising flow channels extending between the at least one partition and corresponding exterior walls to allow water to flow within the container.

5. The mountable container of claim 1, wherein the exterior walls includes a plurality of grooves, the plurality of grooves are configured to receive structural elements of the sloped structure to enhance a connection between the body portion and the sloped structure.

6. The mountable container of claim 1, wherein the ramped surface of the at least one insert accommodates a plant material for displaying plants in a upright orientation, when the body portion is mounted to the sloped structure.

7. The mountable container of claim 1, wherein the ramped surface of the at least one insert slopes upwardly towards the at least one partition.

* * * * *